US007159502B1

(12) United States Patent
Hulsewis et al.

(10) Patent No.: US 7,159,502 B1
(45) Date of Patent: Jan. 9, 2007

(54) SLIDING BLOCK BREECH MECHANISM FOR A CANNON

(75) Inventors: Hans Hulsewis, Duisburg (DE); Eckehard Bohnsack, Unterluss (DE); Heinz-Gunter Breuer, Duisburg (DE)

(73) Assignee: Rheinmetall Waffe Munition GmbH, Dusseldorf (DE)

( * ) Notice: Subject to any disclaimer, the term of this patent is extended or adjusted under 35 U.S.C. 154(b) by 0 days.

(21) Appl. No.: 11/286,186

(22) Filed: Nov. 23, 2005

(51) Int. Cl.
*F41A 3/00* (2006.01)

(52) U.S. Cl. ..... 89/24

(58) Field of Classification Search ..... 89/24, 89/4.2, 26

See application file for complete search history.

(56) References Cited

U.S. PATENT DOCUMENTS

| | | | | |
|---|---|---|---|---|
| 5,014,592 | A | 5/1991 | Zweig et al. | 89/24 |
| 5,604,325 | A | 2/1997 | Balbo et al. | 89/24 |
| 2003/0051600 | A1 | 3/2003 | Breuer et al. | 89/37.14 |

FOREIGN PATENT DOCUMENTS

WO DE 24 611 C 11/1883

WO DE 242 131 C 12/1911

*Primary Examiner*—Michael J. Carone
*Assistant Examiner*—Gabriel J. Klein
(74) *Attorney, Agent, or Firm*—Klaus P. Stoffel; Wolff & Samson PC

(57) ABSTRACT

The invention concerns a sliding block breech mechanism for a cannon with a breech ring arranged at the rear end of a cannon barrel and with a sliding breech block that slides perpendicularly to the longitudinal axis of the cannon barrel in a cavity of the breech ring.

To achieve an improved distribution of force inside the breech ring when the cannon is fired compared to previously known sliding block breech mechanisms and thus to optimize the maximum stress load, the invention proposes to provide a sliding block breech mechanism whose sliding breech block has at least two lugs arranged axially one behind the other, wherein the pressure flanks of the first lugs, i.e., the lugs closer to the cannon barrel, have a positive direction of inclination, and the pressure flanks of the second lugs have a negative direction of inclination. The directions of inclination of the pressure flanks of the roots of the walls of the breech ring, which roots correspond to the lugs, correspond to the directions of inclination of the pressure flanks of the two lugs of the sliding breech block.

5 Claims, 2 Drawing Sheets

SLIDING BLOCK BREECH MECHANISM FOR A CANNON

BACKGROUND OF THE INVENTION

The invention concerns a sliding block breech mechanism for a cannon with a breech ring arranged at the rear end of a cannon barrel and with a sliding breech block that slides perpendicular to the longitudinal axis of the cannon barrel in a cavity of the breech ring.

A sliding block breech mechanism of this type is described, for example, in U.S. Ser. No. 898,840 and DE 198 23 785 A1. In this regard, the opposite side surfaces of the sliding breech block (as viewed in the direction of the longitudinal axis of the cannon barrel have several successive lugs of buttress form, which engage corresponding roots of the walls of the breech ring cavity, so that when the cannon is fired, the flanks of the lugs of the sliding breech block that face away from the cannon barrel and that are formed as contact surfaces (known as pressure flanks) are supported on corresponding pressure flanks of the roots of the walls of the breech ring cavity. The pressure flanks of the individual lugs of the sliding breech block and the pressure flanks of the corresponding roots of the walls of the breech ring in these previously known sliding block breech mechanism basically all have the same direction of inclination.

In addition, U.S. Pat. No. 5,014,592 discloses a sliding block breech mechanism whose sliding breech block has three lugs of a modified buttress form, which are arranged in such a way with respect to the corresponding pressure flanks of the roots of the walls of the breech ring that when the cannon is fired, the contact surfaces (pressure flanks) of the two opposing rear-end lugs of the sliding breech block rest on the corresponding contact surfaces of the breech ring, and the contact surfaces of the other lugs press against the corresponding contact surfaces of the breech ring only when the pressure increases. To this end, the contact surfaces of the lugs that are arranged side by side have different flank angles, which, however, are the same as the flank angles of the corresponding contact surfaces of the roots of the breech ring. In this sliding breech block as well, the individual lugs basically all have the same, namely, positive, direction of inclination (when viewed along the longitudinal axis of the cannon tube towards the muzzle of the cannon barrel.

Furthermore, U.S. Pat. No. 5,014,592 discloses a sliding breech block, on which a tie bar is mounted, which can be slid into the breech ring at the rear end. The tie bar joins the two walls of the breech ring and prevents expansion when the cannon is fired.

SUMMARY OF THE INVENTION

Proceeding from the prior art of U.S. Pat. No. 5,014,592, the objective of the invention is to achieve an improved distribution of force inside the breech ring when the cannon is fired compared to previously known sliding block breech mechanisms and thus to optimize the maximum stress load.

The invention is based essentially on the idea of providing a sliding block breech mechanism whose sliding breech block has at least two lugs arranged only behind the other in the axial direction, wherein the pressure flank of the first lug, i.e., the lug closest to the cannon barrel, has a positive direction of inclination, and the pressure flank of the second lug has a negative direction of inclination. The directions of the pressure flanks of the roots of the walls of the breech ring that correspond to the lugs are the same as the directions of inclination of the pressure flanks of the two lugs.

It was found to be advantageous for the angles of inclination of the pressure flanks of the lugs of the sliding breech block to be 8–12°.

In one embodiment of the invention, the angles of inclination of the pressure flanks of the two lugs of the sliding breech block and the angles of inclination of the pressure flanks of the roots are selected in such a way that when the cannon is fired, first the pressure flanks of the second lugs and the pressure flanks of the corresponding roots of the breech ring come into contact, and then the pressure flanks of the first lugs and the pressure flanks of the corresponding roots of the breech ring come completely into contact over their entire surfaces due to elastic deformation during further loading under the action of the firing of the cannon.

In another embodiment of the invention, the walls of the breech ring cavity are rigidly joined at the rear by a tie bar in order to reduce expansion of the walls of the breech ring immediately upon the introduction of force into the walls when the cannon is fired. In this regard, strain on the tie bar is relieved by the use of the negative inclination of the pressure flanks of the second lugs and the pressure flanks of the roots.

Additional details and advantages of the invention are explained below with reference to the specific embodiments illustrated in the drawings.

DETAILED DESCRIPTION OF THE INVENTION

Figures 1, 2:
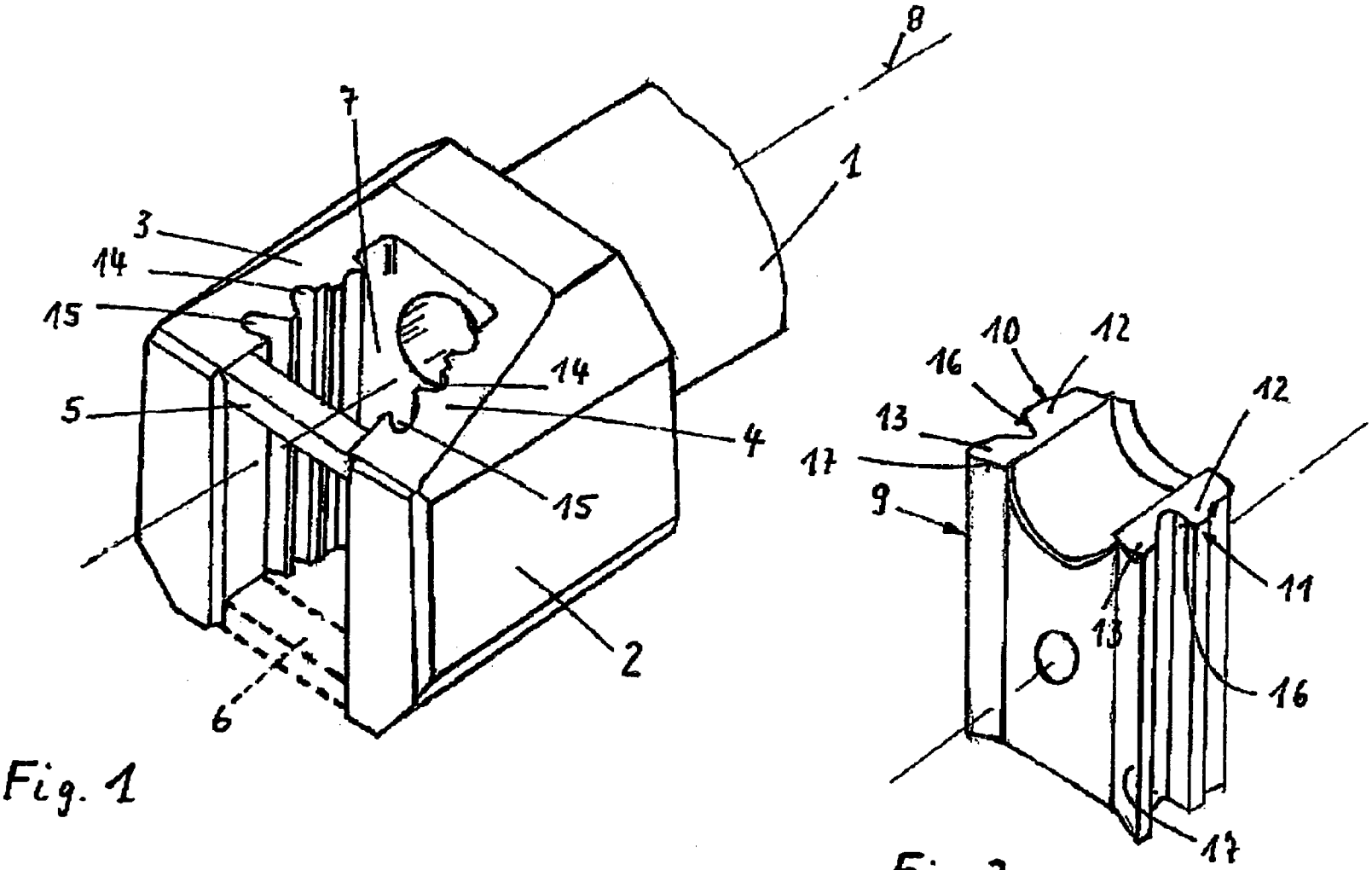
FIG. 1 shows a perspective view of the breech ring of a large-caliber cannon with a sliding block breech mechanism of the invention without the sliding breech block.
FIG. 2 shows the sliding breech block designed for use in the sliding block breech mechanism illustrated in FIG. 1.

FIG. 1 shows a cannon barrel 1, on which a breech ring 2 is mounted at the rear in a manner that is already well known. The breech ring 2 is shaped like a fork towards the rear and has two walls 3, 4, which are rigidly joined by an upper tie bar 5 or a lower tie bar 6 (indicated by broken lines). The walls 3, 4 and the tie bar 5 or 6 of the breech ring 2 bound a cavity 7, in which a sliding breech block 9 (FIG. 2) can be arranged in such a way that it can move perpendicularly to the longitudinal axis 8 of the cannon barrel 1.

Each of the side surfaces 10, 11 of the sliding breech block 9 has two laterally projecting lugs 12, 13 which are arranged one behind the other (as viewed in the direction of the longitudinal axis 8) and engage corresponding roots 14, 15 of the walls 3, 4 of the breech ring 2. Therefore, when the cannon is fired, the flanks of the lugs 12, 13 of the sliding breech block 9, which face away from the cannon barrel and are designed as contact surfaces (known as pressure flanks), are supported on corresponding pressure flanks 18, 19 of the roots 14, 15 of the walls 3, 4 of the breech ring 2. In this regard. The pressure flanks 16 of the first lugs 12 of the sliding breech block 9, i.e., the lugs closer to the cannon barrel 1, and the pressure flanks 18 of the corresponding first roots 14 of the walls both have a positive inclination with angles of inclination $\alpha 1$ and $\beta 1$, respectively (on the order of, e.g., 10°). The pressure flanks 17 of the second lugs 13 of the sliding breech block 9 and the pressure flanks 19 of the corresponding second roots 15 of the walls 3, 4, on the other hand, both have a negative inclination with angles of inclination $\alpha 2$ and $\beta 2$, respectively (of, e.g., also about 10°).

Figure 3:
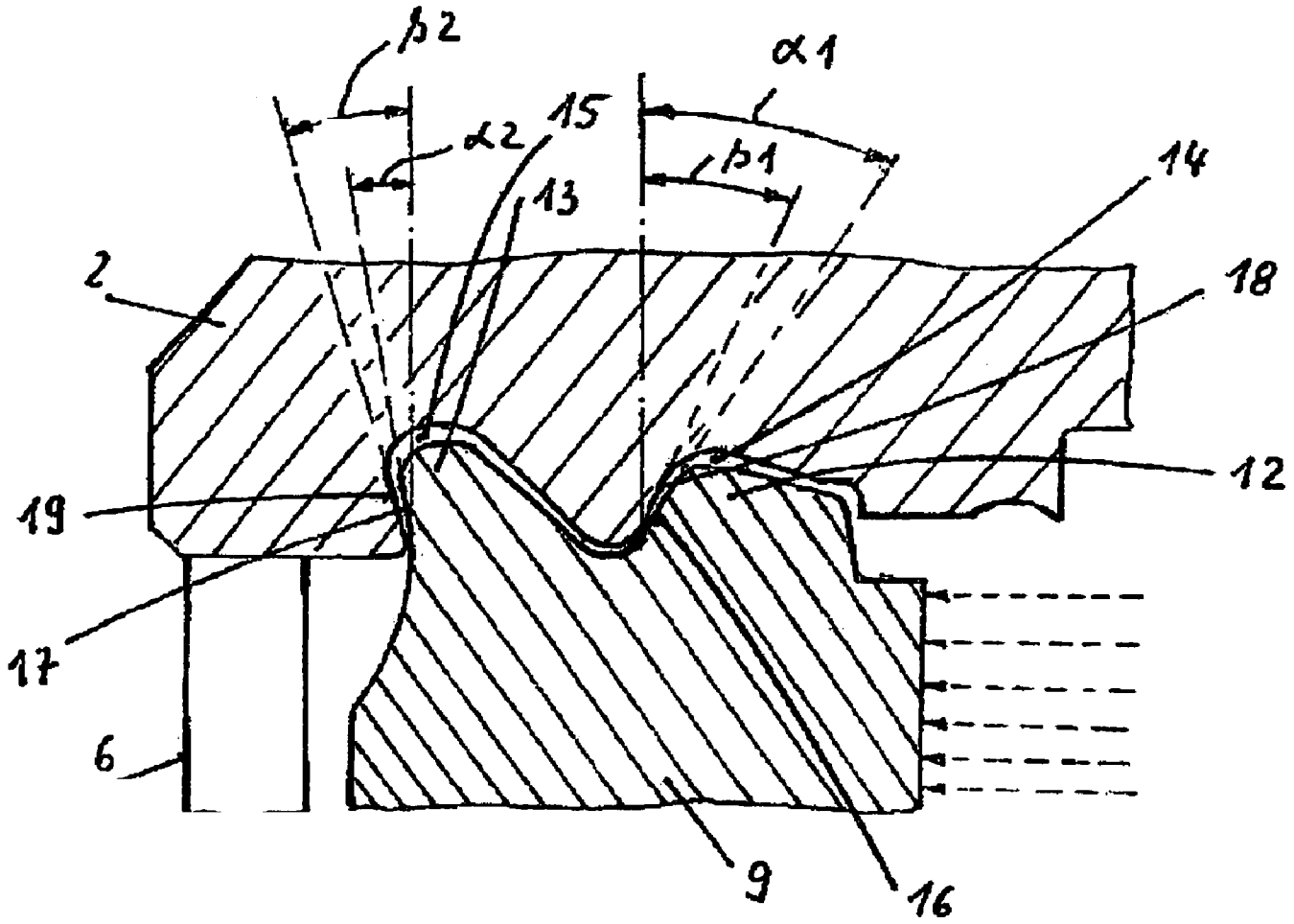
FIG. 3 shows an enlarged longitudinal section of the sliding block breech mechanism illustrated in FIG. 1 with its sliding breech block before a pressure load is applied.

As FIG. 3 shows, the angles of inclination $\alpha 1$ and $\beta 2$ of the pressure flanks 16, 17 of the lugs 12, 13 of the sliding breech block 2 and the angles of inclination $\beta 1$ and $\beta 2$ of the pressure flanks 18, 19 of the roots 14, 15 are different in the illustrated embodiment, so that in the load-free state, only linear contact is present between the pressure flanks 16, 17 of the lugs 12, 13 and the corresponding pressure flanks 18, 19 of the roots 14, 15. Only with an increasing load upon the firing of the cannon are the corresponding pressure flanks 16, 17, 18, 19 of the lugs 12, 13 and roots 14, 15 uniformly pressed against each other, so that linear contact pressure is avoided under a load and thus the risk of wear is reduced.

In addition, it can be provided that the pressure flanks 17 of the second lug 13 under a load first come into contact with the complementary pressure flanks 19 of the second root 15 of the breech ring 2, and then the pressure flanks 16 of the first lug 12 come completely into contact with the complementary pressure flanks 18 of the first root 14 of the breech ring 2 over their entire surfaces due to elastic deformation under the additional load upon the firing of the cannon.

The invention claimed is:

1. A sliding block breech mechanism for a cannon, comprising: a breach ring arranged at a rear end of a cannon barrel and defining a cavity; and a sliding breech block that slides perpendicularly to a longitudinal axis of the cannon barrel in the cavity of the breech ring, the sliding breech block having at least two laterally projecting lugs, which are arranged one behind the other as viewed in the direction of the longitudinal axis of the cannon barrel and engage corresponding roots of walls of the cavity of the breech ring, so that when the cannon is fired, pressure flanks of the lugs of the sliding breech block, which face away from the cannon barrel and are designed as contact surfaces, are supported on corresponding pressure flanks of the roots of the walls of the breech ring, the lugs including first lugs and second lugs, the first lugs being closer to the cannon barrel than the second lugs, the pressure flanks of the first lugs of the sliding breech block and the pressure flanks of the corresponding first roots of the walls both having a positive angle of inclination, and the pressure flanks of the second lugs of the sliding breech block and the pressure flanks of corresponding second roots of the walls both having a negative angle of inclination.

2. The sliding block breech mechanism in accordance with claim 1, wherein the angles of inclination of the pressure flanks of the lugs of the sliding breech block are 8–12°.

3. The sliding block breech mechanism in accordance with claim 1, wherein the angles of inclination of the pressure flanks of the lugs of the sliding breech block and the angles of inclination of the pressure flanks of the roots are different.

4. The sliding block breech mechanism in accordance with claim 1, wherein the angles of inclination of the pressure flanks of the lugs of the sliding breech block and the angles of inclination of the pressure flanks of the roots are selected so that when the cannon is fired, first the pressure flanks of the second lugs and the pressure flanks of the corresponding second roots of the breech ring come into contact, and then the pressure flanks of the first lugs and the pressure flanks of the corresponding first roots of the breech ring come completely into contact over their entire surfaces due to elastic deformation during further loading under action of the firing of the cannon.

5. The sliding block breech mechanism in accordance with claim 1, and further comprising a tie bar arranged at a rear of the walls so as to rigidly join the walls of the cavity of the breech ring.

* * * * *